US005151558A

United States Patent [19]

Rudolf et al.

[11] Patent Number: 5,151,558

[45] Date of Patent: Sep. 29, 1992

[54] AMMUNITION POSSESSING A SUPPORTING MEMBER CONSTITUTED FROM A FOAM MATERIAL

[75] Inventors: Karl Rudolf, Schrobenhausen; Gunter Lehrieder, Rothenbach, both of Fed. Rep. of Germany

[73] Assignee: Diehl GmbH & Co., Nuremberg, Fed. Rep. of Germany

[21] Appl. No.: 746,126

[22] Filed: Aug. 15, 1991

[30] Foreign Application Priority Data

Sep. 21, 1990 [DE] Fed. Rep. of Germany ..... 4029876

[51] Int. Cl.[5] ..... F42B 12/10

[52] U.S. Cl. ..... 102/476; 102/307; 102/517

[58] Field of Search ..... 102/475, 476, 306, 307, 102/308, 309, 310, 305, 501, 517

[56] References Cited

U.S. PATENT DOCUMENTS

| | | | |
|---|---|---|---|
| 2,849,953 | 9/1958 | Delacour | 102/306 |
| 3,211,094 | 10/1965 | Liddiard, Jr. | 102/305 |
| 3,598,058 | 8/1971 | Smith | 102/532 |
| 3,675,577 | 7/1972 | Sternberg et al. | 102/474 |
| 3,732,821 | 5/1973 | Royer | 102/431 |
| 4,359,943 | 11/1982 | Majerus | 102/309 |
| 4,716,835 | 1/1988 | Leemans | 102/501 |
| 4,882,996 | 11/1989 | Bock et al. | 102/496 |

FOREIGN PATENT DOCUMENTS

| | | | |
|---|---|---|---|
| 1946991 | 3/1971 | Fed. Rep. of Germany | 102/476 |
| 3401514 | 7/1985 | Fed. Rep. of Germany . | |

*Primary Examiner*—Stephen M. Johnson
*Attorney, Agent, or Firm*—Scully, Scott, Murphy & Presser

[57] ABSTRACT

An article of ammunition including a projectile-forming insert, wherein a supporting member which is constituted from a foam material is interposed between the insert and a structural component. The foam material possesses, at least in the region bordering against the insert, a density of at most 200 kg/m$^3$.

2 Claims, 1 Drawing Sheet

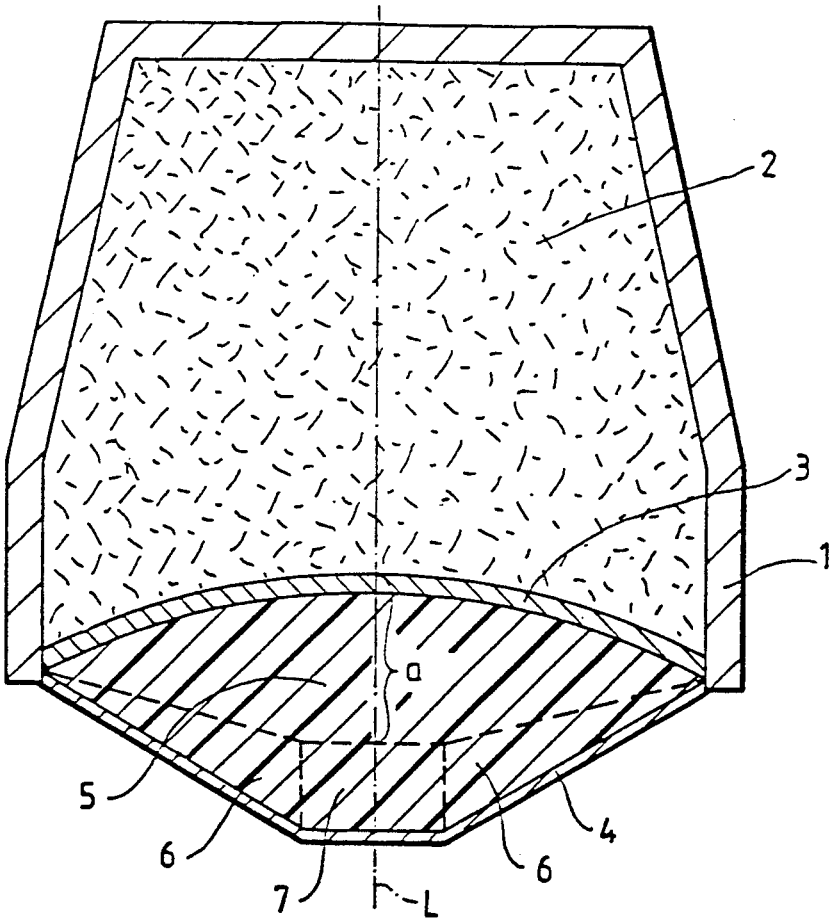
2
3
1
a
5
6
7
6
4
L

AMMUNITION POSSESSING A SUPPORTING MEMBER CONSTITUTED FROM A FOAM MATERIAL

BACKGROUND OF THE INVENTION

1. Field of the Invention

The present invention relates to an article of ammunition including a projectile-forming insert, wherein a supporting member which is constituted from a foam material is interposed between the insert and a structural component.

2. Discussion of the Prior Art

It is known that in an article of submunition, a structural component, especially such as an antenna, can be supported against the insert through the intermediary of a supporting member which consists of a foam material, whereby the insert will form a projectile upon the detonation of an explosive charge. Usually, the foam member is a hardened or cured foam of polyurethane having a density of approximately 250 kg/m$^3$.

It has been ascertained that this supporting member reduces the velocity of the projectile and has a negative influence over the formation of the projectile. Consequently, it has as a result been proposed to correspondingly intensify or boost the explosive charge. This, however, is already inexpedient, inasmuch as the explosive charge must then be designed in conformance with the respective configuration of the supporting member. Consequently, different kinds of supporting members necessitate the employment of different explosive charges.

In the disclosure of German Laid-Open Patent Appln. 34 01 514 A1 there is described a projectile in which a hard or cured foam layer is foamed inbetween the explosive and a detonator. In this case, there is no provision for a projectile-forming insert, so that the above-mentioned difficulties are not encountered.

SUMMARY OF THE INVENTION

Accordingly, an object of the present invention contemplates the provision of an article of ammunition of the above-mentioned type, in which there is avoided the possibility that the supporting member will in any manner exert a negative influence over the velocity and the shape of the projectile being formed.

Inventively, the above-mentioned object is attained in that the foam material possesses, at least in the region bordering against the insert, a density of at most 200 kg/m$^3$, and in particular of 180 kg/m$^3$.

Experiments have indicated that, in a surprising manner, a foam material with such a lowered density will practically not at all influence the speed or velocity and the shape of the projectile. The explosive charge accordingly need not be conformed or correlated with the respectively employed supporting member. Consequently, utilization can be made of the same explosive charge with different supporting members.

In an embodiment of the invention, the foam material possesses a volumetric weight or density at the side thereof which supports the structural component which lies above 200 kg/m$^3$. This improves the support for the structural component, since the supporting member is stronger on its supporting side, however, without thereby negatively influencing the speed or velocity and the shaping of the projectile, inasmuch as the foam material is less dense towards the insert.

BRIEF DESCRIPTION OF THE DRAWING

Reference may now be had to the following detailed description of an exemplary embodiment of an article of ammunition possessing a supporting member consisting of a foam material, shown in a longitudinal sectional view, and taken in conjunction with the single figure of accompanying drawing.

DETAILED DESCRIPTION

Arranged within the casing 1 of an article of submunition is an explosive charge 2 which is bordered by an insert 3. Upon the detonation of the explosive, the insert 3 forms a projectile which moves generally along the middle or centerline L of the submunition.

The submunition possesses a flat-surfaced or planar antenna 4. This antenna supports itself through the interposition of a supporting member 5 against the insert 3. The supporting member 5 consists of a hardened or cured polyurethane foam material having a volumetric weight or density of approximately 180 kg/m$^3$.

Upon the detonation of the explosive charge 2, the supporting member 5 does not hinder the forming of the projectile. Moreover, it does not reduce the speed of the projectile.

The supporting member 5 can consist of a denser foam material in the annular region 6 thereof at which it borders against the antenna 4. At that location it is constituted; for example, from a hardened or cured polyurethane foam possessing a density of approximately 250 kg/m$^3$. As a result thereof, this increases the support for the antenna 4. Inasmuch as the denser foam material is provided only in an annular region 6, it allows a window 7 to remain free in the region of the centerline L, in which the foam material at that location possesses a density of 180 kg/m$^3$. Consequently, the projectile does not have to penetrate through the denser foam material.

The presence of the window 7 in the denser foam material is not absolutely necessary. This is because the forming of the projectile has already been concluded and the projectile has already attained its high initial or launching speed when, after traveling a distance "a", it strikes against the possibly denser foam material, so as to be able to penetrate through the latter without any noticeable loss of speed.

What is claimed is:

1. An article of ammunition including a projectile-forming insert; a supporting member consisting of a foam material being arranged intermediate the projectile-forming insert and a structural component, said foam material having at least two regions wherein a first region bordering the projectile-forming insert consists of foam having a maximum density of about 200 kg/m$^3$ and a second region arranged annularly about a centerline of said ammunition and adjacent the structural component consisting of foam having a density of greater than 200 kg/m$^3$.

2. Ammunition as claimed in claim 1, wherein the foam material in at least said first region bordering the projectile-forming insert has a density of about 180 kg/m$^3$.

* * * * *